US005241244A

United States Patent [19]

Cirri

[11] Patent Number: 5,241,244

[45] Date of Patent: Aug. 31, 1993

[54] CYCLOTRON RESONANCE ION ENGINE

[75] Inventor: Gianfranco Cirri, Firenze, Italy

[73] Assignee: Proel Tecnologie S.p.A., Firenze, Italy

[21] Appl. No.: 844,833

[22] Filed: Mar. 3, 1992

[30] Foreign Application Priority Data

Mar. 7, 1991 [IT] Italy ..... FI91 A 000049

[51] Int. Cl.[5] ..... H05H 1/16

[52] U.S. Cl. ..... 315/111.41; 315/111.31; 315/111.81; 250/423 R; 250/423 F

[58] Field of Search ..... 315/111.21, 111.31, 315/111.41, 111.81; 313/231.31, 359.1; 250/423 R, 423 F

[56] References Cited

U.S. PATENT DOCUMENTS

| | | | |
|---|---|---|---|
| 4,438,368 | 3/1984 | Abe et al. | 315/111.41 X |
| 4,684,848 | 8/1987 | Kaufman et al. | 315/111.81 X |
| 4,713,585 | 12/1987 | Ohno et al. | 315/111.81 |
| 4,739,169 | 4/1988 | Kurosawa et al. | 315/111.81 X |
| 4,806,829 | 2/1989 | Hakano | 315/111.81 |
| 4,825,646 | 5/1989 | Challoner et al. | 315/111.31 X |
| 4,927,293 | 2/1988 | Asmussen et al. | 315/111.81 X |
| 4,937,456 | 6/1990 | Grim et al. | 315/111.41 X |
| 5,081,398 | 1/1992 | Asmussen et al. | 315/111.41 |

*Primary Examiner*—Eugene R. LaRoche
*Assistant Examiner*—Do Huyn Yoo
*Attorney, Agent, or Firm*—McGlew and Tuttle

[57] ABSTRACT

An ion engine for the generation of primary plasma by discharge in a gas wherein the discharge is obtained by the simultaneous use of a magnetic conditioning and confinement field and an electromagnetic field. The latter being at a frequency such that the cyclotron resonance effect of the electrons in the gas can be exploited. The engine generates a static magnetic field and generates and applies an electromagnetic field at cyclotron frequency. By using the cyclotron resonance effect, it is possible to improve the processes of plasma generation and the processes of ion beam extraction by the use of an optimized system of grids made of refractory material. These processes are optimized to match the differences in the operating conditions acting on the intensity of the magnetic field.

17 Claims, 1 Drawing Sheet

CYCLOTRON RESONANCE ION ENGINE

FIELD OF THE INVENTION

The invention relates to an ion engine, as a device for the generation of ions for the purpose of propulsion, particularly for space application. The propulsion ion engine is of the type comprising a discharge chamber in which a propellant gas from a supply line is ionized, and means for ionizing this gas.

BACKGROUND OF THE INVENTION

In known ion engines, the primary plasma from which the ion beam is extracted is obtained in the discharge chamber in two basic ways:

a) by using plasma source based on continuous discharge between an anode and a cathode capable of emitting electrons (a hot filament or a hollow cathode which is heated and may be equipped with an electrode called a "keeper") which, when accelerated in the presence of a static magnetic field, produce the ionization of the gas present in the discharge chamber;

b) by exciting the gas present in the discharge chamber with an electromagnetic field at radio frequency (order of magnitude of the frequency: several MHz).

SUMMARY AND OBJECT OF THE PRESENT INVENTION

The present invention relates to a different approach to the generation of the primary plasma in the discharge chamber, and obtaining a number of advantages and uses with respect to the known techniques, as will be clear to experts in the field from a reading of the following text.

According to the invention, the charged particles (electrons and ions) present in the discharge chamber are conditioned and confined by a magnetic field, and the ionization of the propellant gas is achieved by accelerating the free electrons by means of an electromagnetic field at a frequency resonating with their cyclotron frequency.

In substance, therefore, the device according to the invention provides, for the ionization of the gas, first means for the generation of a substantially static magnetic field for confining and conditioning, and second means for the application of an electromagnetic field with a frequency near or equal to the cyclotron resonance frequency of the electrons corresponding to the intensity of the static magnetic field generated by said first means.

The magnetic field of the cyclotron resonance which is used to ionize the gas, can have a fixed and variable component. The variable component can be varied to account for different operating conditions. The fixed component of a magnetic field can be generated by a permanent magnet.

The application of cyclotron resonance to the generation of ions is known in the industrial field, for example in the techniques of ion etching and deposition of materials. However, this type of plasma generation technology has never been considered in the field of ion propulsion, particularly in space applications. Surprisingly, however, it has been found that the construction of ion engines with cyclotron resonance generation has numerous advantages with respect to the techniques hitherto used, as illustrated below.

The static magnetic field may be produced by permanent magnets and/or by coils, and is to be considered a parameter of the primary plasma production process. The magnetic field may be made to have adjustable intensity in order to optimize the performance of the ion engine under various operating conditions. More particularly, according to a particularly advantageous embodiment of the engine according to the invention, the magnetic field may have:

a fixed component generated preferably by permanent magnets (although the use of coils is not excluded), with a suitable spatial distribution (generally non-uniform, in order to increase the velocity of the ions in the direction of the ion beam extraction region) so as to enhance the effects of cyclotron resonance along the discharge chamber, while simultaneously making it possible to optimize the coupling between the energy at radio frequency and the plasma, and to confine the plasma, limiting the losses towards the walls. The excitation frequency is matched to the fixed component of the magnetic field;

a supplementary adjustable component generated by means of coils. The adjustment is used to maximize ion production when there are variations in the flow of gas (and therefore in the pressure in the discharge chamber), thus minimizing gas consumption under various operating conditions.

The principal advantages offered by the device according to the invention with respect to known engines are as follows:

a) with respect to engines with plasma sources based on continuous discharge;
   - a1) absence of the cathode and anodes or other accelerating electrodes which are subject to erosion by the plasma and consequently constitute critical elements for limiting the life of the device;
   - a2) greater uniformity of the plasma in the discharge chamber, with consequent elimination of concentrations adversely affecting the reliability and life of the device, and better characteristics of the beam produced, in terms of divergence and directional stability;
   - a3) a smaller number of components inside the discharge chamber, with consequent higher reliability and simplicity of design.

b) with respect to engines with sources of plasma excited at radio frequency:
   - b1) the static magnetic field permits better plasma confinement, limiting the losses towards the walls and ultimately permitting operation at lower pressures and savings in terms of electrical power;
   - b2) the static magnetic field constitutes an additional parameter which may be optimized in real time according to the operating conditions, and which consequently makes the ion engine more flexible.

c) with respect to all ion engines known at the present time:
   - c1) by exploiting the cyclotron resonance of the electrons, it is possible to transfer their energy selectively, leaving in the cold state, (ion energy $<1$ eV) ions for which the conditions of cyclotron resonance are not present;
   - c2) as a result of what is described in c1, it is possible to limit the temperature of the ions and consequently of the walls of the discharge chamber, making the design of the engine simpler and more reliable;
   - c3) as a result of what is described in c1, it is possible to obtain ions having a smaller energy dispersion, permitting more predictable and accurate operation of the ion beam focusing system;

c4) as a result of what is described in c3, it is possible to design high-performance focusing systems which limit the size and effects of ion bombardment on the extraction grids, with consequent higher reliability and longer life of these grids;

c5) as a result of what is described in c3, it is possible to design high-performance focusing systems which optimize the extraction of the ions with respect to the neutral particles from the discharge chamber, with an improvement of the ratio between the thrust and the consumption of propellant gas;

c6) by exploiting the cyclotron resonance it is possible to obtain high electron energies (up to 10 KeV) with the possibility of obtaining a high percentage of multiple ions (with double or triple charges, etc.) and consequently an improved ratio between the thrust and the consumption of propellant gas. In fact, other thins being equal, the thrust T is proportional to the square root of the charge of the ion. The negative effects of multiple ions (greater erosion of the grids and of the walls of the discharge chamber) are avoided by careful design of the engine, particularly by optimizing the extraction lenses (with respect to the number, shape and polarization of the grids);

c7) by exploiting the cyclotron resonance it is possible to obtain within the discharge chamber a plasma of high density (of the order of $10^{11}$–$10^{12}$ ions/cm$^3$) even at low pressure (of the order of $10^{-4}$ torr), with an improvement in the ratio between the thrust and the consumption of propellant gas.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
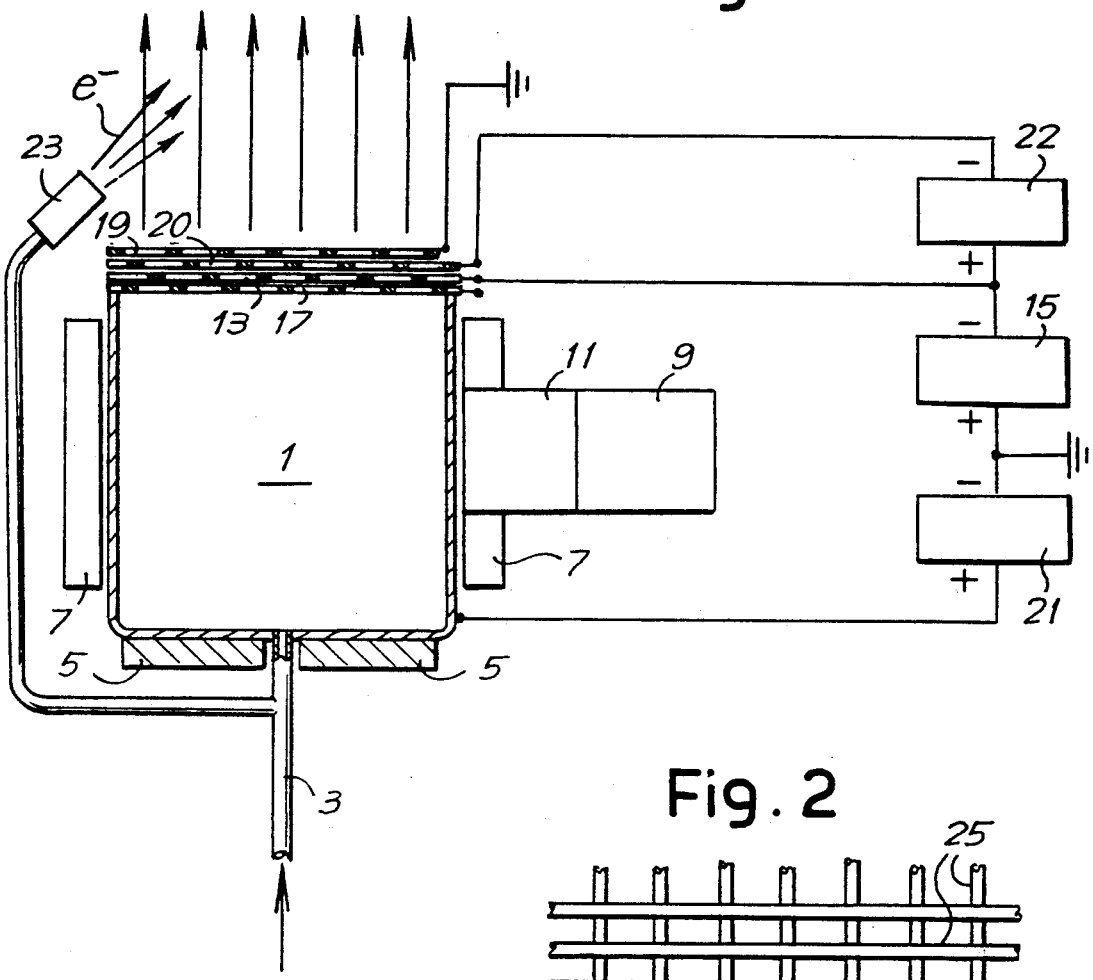
FIG. 1 is a schematic longitudinal section.

The discharge chamber, indicated as a whole by 1, receives the propellant gas from the gas supply line 3. Around the discharge chamber 1 there is installed a device, schematically indicated by 5 and 7, for the generation of the static magnetic field, consisting of permanent magnets and/or coils and associated power supply units. In the example illustrated, the device for the generation of the magnetic field comprises permanent magnets 5 which provide a fixed component of the static magnetic field, and a coil 7 which provides the variable component. It is to be understood that the disposition and configuration of these means may be different from those shown schematically.

The electromagnetic field for the acceleration of the electrons at frequencies near to the cyclotron resonance is obtained by means of a radio frequency or microwave generator 9 and a coupling system indicated as a whole by 11. In one possible embodiment, the coupling system 11 makes allowance for the increase in density of the plasma from the inlet of the gas to the ion beam extraction region, or for the variation of the electrical charge along the longitudinal axis of the engine, in such a way as to optimize the coupling between the energy at radio frequency and the plasma in the various regions of the discharge chamber. This is achieved by varying the spatial development of the electrical field by the use of a coupling system with parameters which be varied along the axis of the engine. Similarly, the longitudinal distribution of the magnetic field may be arranged in such a way as to optimize the plasma production process in the various regions of the discharge chamber.

The discharge chamber 1 may be terminated above by a system of grids which enables the ion beam to be extracted from the plasma and to be accelerated, while limiting the flow of non-ionized propellant gas to improve the exploitation of the propellant itself. In the example illustrated, this system comprises an intermediate accelerating grid 13 which is polarized by an accelerating voltage generator 15, whose negative pole is connected to the accelerating grid 13. The grid system also comprises an inner screen grid 17 and an outer decelerating grid 19. The latter two grids, 17 and 19, are polarized in such a way as to prevent the electrons present outside from penetrating into the discharge chamber 1 and to prevent excessive bombardment and erosion of the accelerating grid 13 by the ions originating from the discharge chamber. The decelerating grid 19 is connected to ground, while the screen grid 17, at the same potential as the walls of the discharge chamber 1, is connected to the positive pole of a power supply unit 21, which supplies the electrical power associated with the propulsive thrust of the ion engine.

The system of grids may be omitted if required, in which case a suitable magnetic field keeps the particles confined in the discharge chamber 1 and enables kinetic energy to be transferred to the ions of the beam. This magnetic field may be provided by the means 5 and 7 or by other magnets provided specifically for this purpose.

Between the accelerating grid 13 and the decelerating grid 19 there may be interposed a fourth grid 20, called a "diverter", with the purpose of reducing the ion flow generated as a result of the phenomenon of charge exchange and intercepted by the accelerating grid 13, thus reducing the erosion of the latter grid, with advantages in terms of service life. The grid 20 is at a more negative potential than the other grids of the system and is connected to a suitable power supply unit 22.

Figure 2:
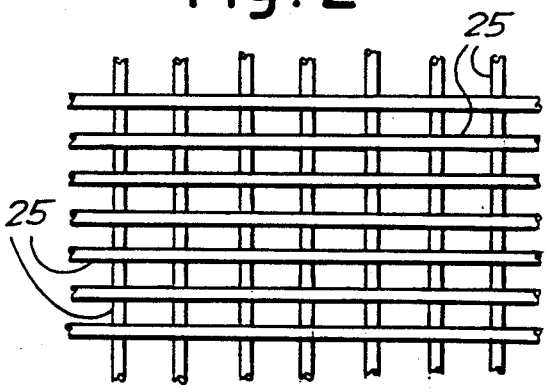
FIG. 2 is an enlarged detail of a possible embodiment of a grid.

In order to optimize the ion extraction process and to minimize the erosion phenomena due to the impact of the charges on the grids, one or more of the grids of the extraction system may consist of a matrix of wires 25 (FIG. 2) made of refractory material, such as tungsten, tantalum, or others, electrically spot welded at the points of intersection. The geometrical characteristics of the matrix (size and shape of the lattice and cross-section of the wire) are optimized to reduce the erosion of the grids and optimize the extraction process.

The engine also comprises a neutralizer 23 supplied with the same propellant gas as that used for the discharge chamber 1; this has the function of compensating, with the emission of $e^-$ electrons, the flow of positive charges associated with the operation of the ion engine, preventing the electrostatic charging of the space vehicle on which the engine is mounted, as well as the stoppage of the operation of the engine itself as a result of the spatial charge associated with the beam of positive ions extracted from the discharge chamber 1.

The cyclotron resonance condition is present at excitation frequencies of 2.9 MHz per gauss of the static magnetic field B. The choice of excitation frequency and magnetic field is limited at the lower end of the dimensions of the discharge chamber, since the circumference described by an electron, having sufficient energy to ionize a gas molecule, must cover a region in which the electrical excitation field has the same direction and must at all events be smaller than the dimensions of said discharge chamber 1.

The radius $r_e$ of the circumference described by an electron of energy Te in a magnetic field B is given by:

$$r_e = 3.8\sqrt{\mathrm{Te}}\,/B \ (r_e \text{ in cm, Te in eV, } B \text{ in gauss})$$

The upper limit for the excitation frequency and the magnetic field is represented by the convenience and/or practical feasibility of producing magnetic field of high intensity.

In the present state of the art, the identified useful range lies between 10 MHz–3.5 gauss (corresponding to a radius of the cyclotron circumference of approximately 5 cm) and 10 GHz–3500 gauss. However, a future increase of this range cannot be ruled out, owing to the progress of the art or the need to construct engines having particular dimensions or performance.

The choice of the frequency and amplitude of the electromagnetic excitation field is also dependent on the spatial distribution of the physical variables which affect the penetration of the electromagnetic field into the working volume of the discharge chamber 1 and the efficiency of the energy transfer to the plasma, these physical variables comprising the density of the neutral particles (in other words of the particles which are not electrically charged), the density of the ions, and the mean free path of the electrons.

It is to be understood that the drawing illustrates only an example provided solely as a practical demonstration of the invention, the invention being capable of variation in its forms and dispositions without thereby departing from the scope of the concept of the invention itself. Any reference numbers in the attached claims have the purpose of facilitating the reading of the claims with reference to the description and to the drawing, and do not limit the scope of protection represented by the claims.

I claim:

1. An engine for propelling a vehicle, the engine comprising:

a discharge chamber defining an opening on a side substantially opposite to a direction of the propelling, said discharge chamber being in communication through said opening with an environment surrounding the engine;

supply means for supplying a gas to said discharge chamber;

ionizing means for ionizing said gas in said discharge chamber, said ionizing means including a magnetic means for generating a magnetic field inside said discharge chamber, said magnetic field including a fixed component and a variable component, said ionizing means including an electromagnetic field means for generating an oscillating electromagnetic field inside said discharge chamber; and grid means, positioned across said opening of said discharge chamber, for generating a force on said discharge chamber in said direction of propelling by discharging a portion of said ionized gas out of said discharge chamber, through said opening and said grid means, and into said environment surrounding the engine, said discharge of said portion of said ionized gas being in said direction substantially opposite to said direction of propelling.

2. The engine as claimed in claim 1, wherein the electromagnetic field is applied to the discharge chamber by means of one of a radio frequency and microwave generator and a coupling system.

3. The engine as claimed in claim 1, wherein said magnetic means includes a first element for generating said fixed component of said magnetic field and a second element for generating said variable component of said magnetic field.

4. The engine as claimed in claim 3, wherein said magnetic means includes a coil as said second element for generation of said variable component of said magnetic field and one of a coil and a permanent magnet as the first element for generating said fixed component of said magnetic field.

5. The engine as claimed in claim 1, wherein: said magnetic field has a non-uniform longitudinal distribution to optimize plasma production process in various regions of the discharge chamber.

6. The engine as claimed in claim 1, wherein said grid means include a screen grid, an accelerating grid and a decelerating grid.

7. The engine as claimed in claim 6, wherein one or more of said grids consists of a matrix of wires made of refractory material electrically spot welded at points of intersection.

8. The engine in accordance with claim 2, wherein:

said coupling system includes means for varying parameters along a longitudinal axis of said discharge chamber for optimizing a coupling between radio frequency energy and plasma in various regions of said discharge chamber.

9. The engine in accordance with claim 1, wherein:

the vehicle is in a space craft and said discharge opening communicates with a vacuum environment surrounding the space craft.

10. The engine in accordance with claim 1, wherein:

said oscillating of said electromagnetic field is within a frequency range of 50–300 MHz.

11. The engine in accordance with claim 1, wherein:

said magnetic means includes a permanent magnet for generating said fixed component of said magnetic field, said magnetic means also includes a coil for generating said variable component of said magnetic field.

12. The engine in accordance with claim 11, wherein:

said coil adjust an intensity of said magnetic field to optimize the performance of the engine during operating conditions of the engine.

13. The engine in accordance with claim 1, further comprising:

neutralizer means for neutralizing a charge on the vehicle caused by said discharging of said portion of said ionized gas, and also for neutralizing a spatial charge associated with said discharge portion of said ionized gas, said neutralizer means emitting electrons and being supplied with said gas from said supply means.

14. A method for propelling a vehicle, the method comprising the steps of:

providing a discharge chamber defining an opening on a side substantially opposite to a direction of the propelling, said discharge chamber being in communication through said opening with an environment surrounding the vehicle;

supplying gas to said discharge chamber;

generating a static magnetic field;

generating an oscillating electromagnetic field at a frequency substantially similar to a cyclotron resonance frequency, said static magnetic field and said oscillating electromagnetic field ionizing said gas in said discharge chamber;

propelling said discharge chamber and the vehicle in a first direction by ejecting a portion of said ionized gas from said discharge chamber in a second direction substantially opposite to said first direction;

generating a variable magnetic field in addition to said static magnetic field; and adjusting an intensity of said variable magnetic field to optimize the propelling in accordance with present operating conditions.

15. The method as claimed in claim 14, wherein a pressure of an order of magnitude of $10^{-4}$ torr and a plasma density of an order of $10^{11}$-$10^{12}$ ions/cm$^3$ is maintained within the discharge chamber.

16. The method in accordance with claim 14, further comprising:

exploiting cyclotron resonance to obtain high electron energies up to 10 KeV and multiple ions for an increase in the propelling in comparison to said supply of gas.

17. An engine for propelling a vehicle, the engine comprising:

a discharge chamber defining an opening on a side substantially opposite to a direction of the propelling, said discharge chamber being in communication through said opening with an environment surrounding the engine;

supply means for supplying a gas to said discharge chamber;

ionizing means for ionizing said gas in said discharge chamber, said ionizing means including a magnetic means for generating a magnetic field inside said discharge chamber, said magnetic field including a fixed component and a variable component, said ionizing means including an electromagnetic field means for generating an oscillating electromagnetic field inside said discharge chamber; and a plurality of grids positioned across said opening of said discharge chamber, said plurality of grids includes an inner screen grid electrically connected to said discharge chamber, and said inner screen grid and said discharge chamber being at a first electrical potential that is positive with respect to ground, said plurality of grids also including an acceleration grid positioned on a side of said inner screen grid substantially opposite said discharge chamber, said acceleration grid being at a second electrical potential that is negative with respect to ground, said plurality of grids also including a diverter grid positioned on a side of said acceleration grid substantially opposite said inner screen grid, said diverter grid being at a third electrical potential that is more negative than said second electrical potential, said plurality of grids also including a decelerating grid positioned on a side of said diverter grid substantially opposite said acceleration grid, said decelerating grid being at a ground potential.

* * * * *